US006883729B2

(12) United States Patent
Putvinski et al.

(10) Patent No.: US 6,883,729 B2
(45) Date of Patent: Apr. 26, 2005

(54) HIGH FREQUENCY ULTRASONIC NEBULIZER FOR HOT LIQUIDS

(75) Inventors: Sergei Putvinski, La Jolla, CA (US); Boris V. Kuteev, St. Petersburg (RU)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 10/453,906

(22) Filed: Jun. 3, 2003

(65) Prior Publication Data

US 2004/0256486 A1 Dec. 23, 2004

(51) Int. Cl.[7] ..... B05B 3/04; B05B 15/00; B05B 17/04; A61M 11/00; A61H 1/00

(52) U.S. Cl. ..... 239/338; 239/102.1; 239/102.2; 239/132; 239/132.3; 239/4; 128/200.14; 128/200.16; 128/200.18; 601/2; 601/48

(58) Field of Search ..... 239/102.1, 102.2, 239/132, 132.3, 4, 338; 128/200.16, 200.14, 200.18; 601/2, 48

(56) References Cited

U.S. PATENT DOCUMENTS 3,901,443 A * 8/1975 Mitsui et al. ..... 239/102.2
4,271,100 A * 6/1981 Trassy ..... 239/291
4,431,901 A 2/1984 Hull
4,987,007 A * 1/1991 Wagal et al. ..... 427/526
5,225,740 A 7/1993 Ohkawa
5,250,773 A 10/1993 Lind et al.
5,350,454 A 9/1994 Ohkawa
5,560,844 A 10/1996 Boulos et al.
5,611,947 A 3/1997 Vavruska
6,251,281 B1 6/2001 Ohkawa
6,251,282 B1 6/2001 Putvinski et al.
6,446,878 B1 * 9/2002 Chandra et al. ..... 239/1

* cited by examiner

*Primary Examiner*—David A. Scherbel
*Assistant Examiner*—Seth Barney
(74) *Attorney, Agent, or Firm*—Nydegger & Associates

(57) ABSTRACT

A nebulizer for atomizing a high-temperature liquid includes a truncated, conical concentrator that defines a vertex and that has a small-diameter end and a large-diameter end. The small-diameter end has a spherical-shaped, concave surface and the large-diameter end has a spherical-shaped, convex surface. A piezoelectric transducer has a spherical-shaped, concave surface that is attached to the convex surface of the concentrator. A cylindrical-shaped droplet manifold is positioned over the small-diameter end of the concentrator to create a liquid chamber in the manifold with the vertex inside the liquid chamber. A feeding tube introduces the high-temperature liquid into the liquid chamber until the surface of the liquid reaches the vertex. With an activation of the transducer, acoustic waves that have spherical wavefronts are launched away from the concave surface of the transducer. The concentrator propagates and directs the spherical wavefronts for convergence at the vertex to nebulize the liquid.

20 Claims, 2 Drawing Sheets

HIGH FREQUENCY ULTRASONIC NEBULIZER FOR HOT LIQUIDS

FIELD OF THE INVENTION

The present invention pertains generally to devices and methods for nebulizing liquids. More particularly, the present invention pertains to devices and methods that use acoustic waves for nebulizing liquids. The present invention is particularly, but not exclusively, useful as a device for nebulizing a high-temperature liquid.

BACKGROUND OF THE INVENTION

A nebulizer is a device that can be used for converting a liquid into droplets. For some applications, it may be desirable to nebulize a relatively high-temperature liquid (i.e., above 100° C.) into small-diameter droplets (i.e., less than 10 $\mu$m). For example, one such application exists in the field of plasma processing. Specifically, in plasma processing, it may be desirable to nebulize a material with a high melting temperature into small-diameter droplets that can then be further heated to create a plasma of the material. Indeed, there are numerous other applications wherein the nebulizing of high-temperature liquids may be required. For example, in powder metallurgy it may be desirable to nebulize a molten solder or a dry molten sodium hydroxide (NaOH), which has a melting temperature of 320 degrees Centigrade (320° C.), into droplets that have diameters in the range of one to three microns (1–3 $\mu$m).

One type of well known nebulizer is a so-called ultrasonic nebulizer. In the operation of an ultrasonic nebulizer, acoustic waves having an ultrasonic frequency are directed to a point on the surface of the liquid that is to be atomized. At the point on the surface of the liquid where these ultrasonic waves converge, they will produce capillary waves that oscillate at the frequency of the ultrasonic waves and have amplitudes that correspond to the energy that is in the ultrasonic waves. It then happens, at sufficiently large amplitudes (i.e., high energy ultrasonic waves), that the peaks of the capillary waves tend to break away from the liquid and be ejected from the surface of the liquid in the form of droplets. In this process, the diameter of the droplets that are formed will generally be inversely proportional to the frequency of the capillary waves.

A device that is often used for generating ultrasonic waves in an ultrasonic nebulizer is a piezoelectric transducer. As is well known, a piezoelectric transducer will vibrate and generate ultrasonic waves in response to an applied electric field. Of particular importance, insofar as nebulizers are concerned, is the fact that piezoelectric transducers can operate at relatively high frequencies and, thus, can be used to nebulize a liquid into droplets that have relatively small diameters. Piezoelectric transducers, however, have limited operational temperature ranges. More specifically, piezoelectric transducers are typically made of piezoelectric ceramic materials that lose their piezoelectric properties above the Curie temperature of the material. Consequently, at high operational temperatures, most piezoelectric materials will no longer vibrate in response to an applied electric field. It happens that for most piezoelectric ceramic materials, the Curie temperature is less than three hundred degrees Centigrade (300° C.). In general, most piezoelectric transducers will not effectively operate above about one hundred degrees Centigrade (100° C.).

For the effective operation of an ultrasonic nebulizer that incorporates a piezoelectric transducer, it is obviously desirable to transfer as much energy as possible from the piezoelectric material to the point where the liquid is being nebulized. An effective way to do this is for the transducer to be in contact with the liquid. However, as discussed above, when high-temperature liquids are to be nebulized, the conductive transfer of heat from the liquid to the transducer can adversely affect the operation of the transducer. This fact has required that the liquid be at a relatively low temperature in order for the transducer to function properly. Accordingly, the adverse effect that high temperatures have on piezoelectric materials has effectively limited their use in nebulizers.

In attempts to overcome the high-temperature issue noted above, one type of ultrasonic nebulizer that has been employed to nebulize high-temperature liquids is a rod nebulizer. In a rod nebulizer, the piezoelectric transducer is attached to one end of the rod, and the free end of the rod is placed in contact with the high-temperature liquid that is to be nebulized. When activated, the piezoelectric transducer causes the free end of the rod to vibrate at its resonant frequency. The resultant vibrating action nebulizes the high-temperature liquid into droplets. A rod nebulizer, however, has a limited operational frequency range that is dependent on the length of the rod. Furthermore, the higher frequencies that are needed for most applications require shorter rods. Thus, heat transfer through the rod to the transducer, again, becomes a problem.

In light of the above, it is an object of the present invention to provide a device and method for nebulizing high-temperature liquids (e.g. liquids with temperatures above three hundred degrees Centigrade) into small-diameter droplets. Another object of the present invention is to provide a device and method for distancing a piezoelectric transducer from a high-temperature liquid in a nebulizer to maintain the temperature of the transducer at an operational temperature. Yet another object of the present invention is to provide a device and method for nebulizing a liquid that is relatively easy to manufacture, is simple to use, and is comparatively cost effective.

SUMMARY OF THE INVENTION

In accordance with the present invention, a system and method are provided for nebulizing a high-temperature liquid into relatively small-diameter droplets. In overview, the system includes a liquid chamber for holding the high-temperature liquid that is to be nebulized. The system also includes a piezoelectric ceramic transducer for generating the acoustic waves that will nebulize the liquid. Additionally, the system incorporates a truncated, conical concentrator that thermally separates the liquid in the chamber from the transducer.

As envisioned for the present invention, the concentrator is preferably solid, is substantially conical-shaped and is, preferably, made of a stainless steel material. Being conically shaped, the concentrator defines a vertex. Further, the cone is truncated to create a first end for the concentrator that is substantially parallel to the base (i.e. second end) of the concentrator. For the purposes of the present invention, it is important that an enclosure be attached to cover the first end of the concentrator. Also, it is important that this enclosure have a substantially spherical-shaped surface that is located at a first radial distance from the vertex.

The piezoelectric transducer for the present invention is attached to the second end (i.e. base) of the concentrator. Importantly, this transducer has a spherical-shaped surface, and it is positioned at a second radial distance from the vertex such that the transducer surface, which faces toward the first end of the concentrator, is substantially parallel to the enclosure that is located at the first end of the concentrator. In this arrangement, the second radial distance between the transducer and the vertex is greater than the first radial distance between the enclosure and the vertex. Preferably the transducer is made of a piezoelectric ceramic material which has a resonant frequency of approximately 2 MHz.

As indicated above, in addition to the concentrator and transducer, the system for the present invention also includes a hollow, substantially cylindrical-shaped droplet manifold. Structurally, the manifold defines a longitudinal axis and it has both an open first end and an open second end. In its combination with the concentrator, the manifold is positioned with its first end over the first end of the concentrator. As so positioned, the manifold presses against the concentrator to establish a substantially fluid-tight seal at the interface between the manifold and the concentrator. Further, the axis of the manifold is oriented so that it passes through the vertex of the concentrator. Thus, the liquid chamber is established inside the manifold above the concentrator, with the enclosure at the first end of the concentrator being positioned in the liquid chamber.

The liquid that is to be nebulized by the system of the present invention is introduced into the liquid chamber through a tube that is attached in fluid communication with the manifold. Importantly, the flow of liquid through this tube is controlled to maintain a surface level for the liquid in the chamber that is substantially coincident with the vertex of the concentrator.

In addition to the structure disclosed above, the system for the present invention may include several ancillary components. For one, the system may include a heater that is incorporated to surround the liquid chamber. The purpose here is to maintain the liquid above its melting temperature while it is in the liquid chamber (e.g. a temperature above approximately three hundred degrees Centigrade (300° C.)). Also, the system may include a pressure vessel that surrounds the interface between the concentrator and the manifold. The purpose in this case is to create an overpressure at the interface that will prevent a leak of the liquid from the liquid chamber. Further, the system may include a cooling drum for cooling the transducer. If used, this cooling drum will preferably have a wall that surrounds a channel, and it will have an opening through the wall that allows a portion of the transducer to extend into the channel. A fluid pump can then be used to pass a coolant through the channel to absorb heat from the transducer and thereby maintain the transducer at a temperature below approximately 100 degrees Centigrade (100° C.).

In the operation of the system, the high-temperature liquid from the liquid source is introduced into the liquid chamber through the feeding tube until the surface level of the liquid in the liquid chamber reaches the vertex. For example, the liquid can be dry sodium hydroxide (NaOH) that is at a temperature above three hundred and twenty degrees Centigrade (320° C.). Once the liquid is in the chamber, the piezoelectric transducer is activated to launch acoustic waves from the transducer that have substantially spherical wavefronts. The concentrator then propagates and directs the spherical wavefronts toward the vertex. At the vertex, the spherical wavefronts converge at a point on the surface of the liquid to nebulize the liquid into droplets. Preferably, the frequency of the wave is approximately two megahertz (2 MHz) and the droplets that are generated will have diameters in the range of one to three microns (1–3 $\mu$m). As the liquid is being nebulized, droplets of the liquid can be removed from the chamber, and additional liquid from the fluid source can be introduced into the liquid chamber to maintain the surface level of the liquid at the vertex.

Preferably, during operation of the system, the pressure vessel maintains an overpressure at the interface to reinforce the fluid-tight seal, and the heater maintains the temperature of the liquid in the liquid chamber above three hundred degrees Centigrade (300° C.). Regardless of the temperature of the liquid in the liquid chamber, the temperature of the piezoelectric transducer is preferably maintained below one hundred degrees Centigrade (100° C.). To accomplish this, the concentrator effectively distances the transducer from direct contact with the liquid chamber. Also, the fluid pump circulates a fluid through the channel of the cooling drum to absorb heat from the piezoelectric transducer and maintain the piezoelectric transducer within its operational temperature range.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
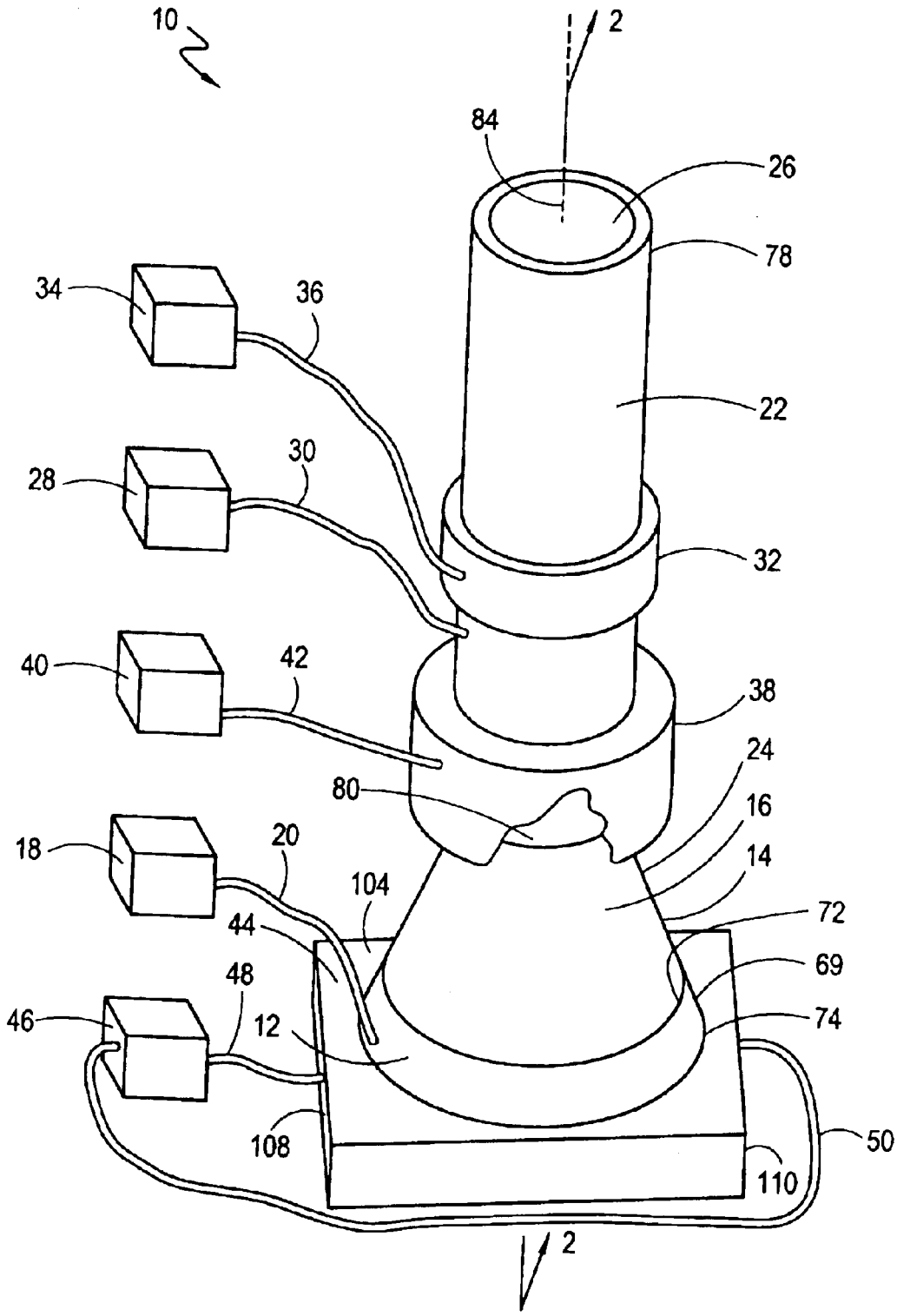
FIG. 1 is a perspective view of a nebulizer in accordance with the present invention.

Referring initially to FIG. 1, a nebulizer system in accordance with the present invention is shown and is generally designated 10. The system 10 includes a transducer 12 that is positioned at the end 14 of a conical concentrator 16. As shown, a power source 18 is connected to the transducer 12 via a power line 20. The system 10 also includes a substantially cylindrical-shaped droplet manifold 22 that is positioned over the end 24 of the conical concentrator 16 to create a liquid chamber 26 inside the manifold 22. Additionally, a high-temperature liquid source 28 is connected to the liquid chamber 26 via a tube 30 to establish fluid communication between the liquid source 28 and the liquid chamber 26.

The system 10 can also include a heater 32 that is mounted to the manifold 22 to surround the liquid chamber 26. As shown, the heater 32 is connected to a power source 34 via a power line 36. The system 10 can further include a pressure vessel 38 that surrounds at least a portion of the manifold 22 and at least a portion of the conical concentrator 16 at end 24. For purposes of the present invention, a gas compressor 40 is connected to the pressure vessel 38 via a pressure line 42 to establish fluid communication between the gas compressor 40 and the pressure vessel 38. The system can also include a cooling drum 44 that is positioned adjacent the transducer 12 and is connected to a fluid pump 46 via both a supply line 48 and a return line 50. Preferably the fluid pump 46 will include a heat exchanger that removes heat from the cooling fluid (e.g. water).

Figure 2:
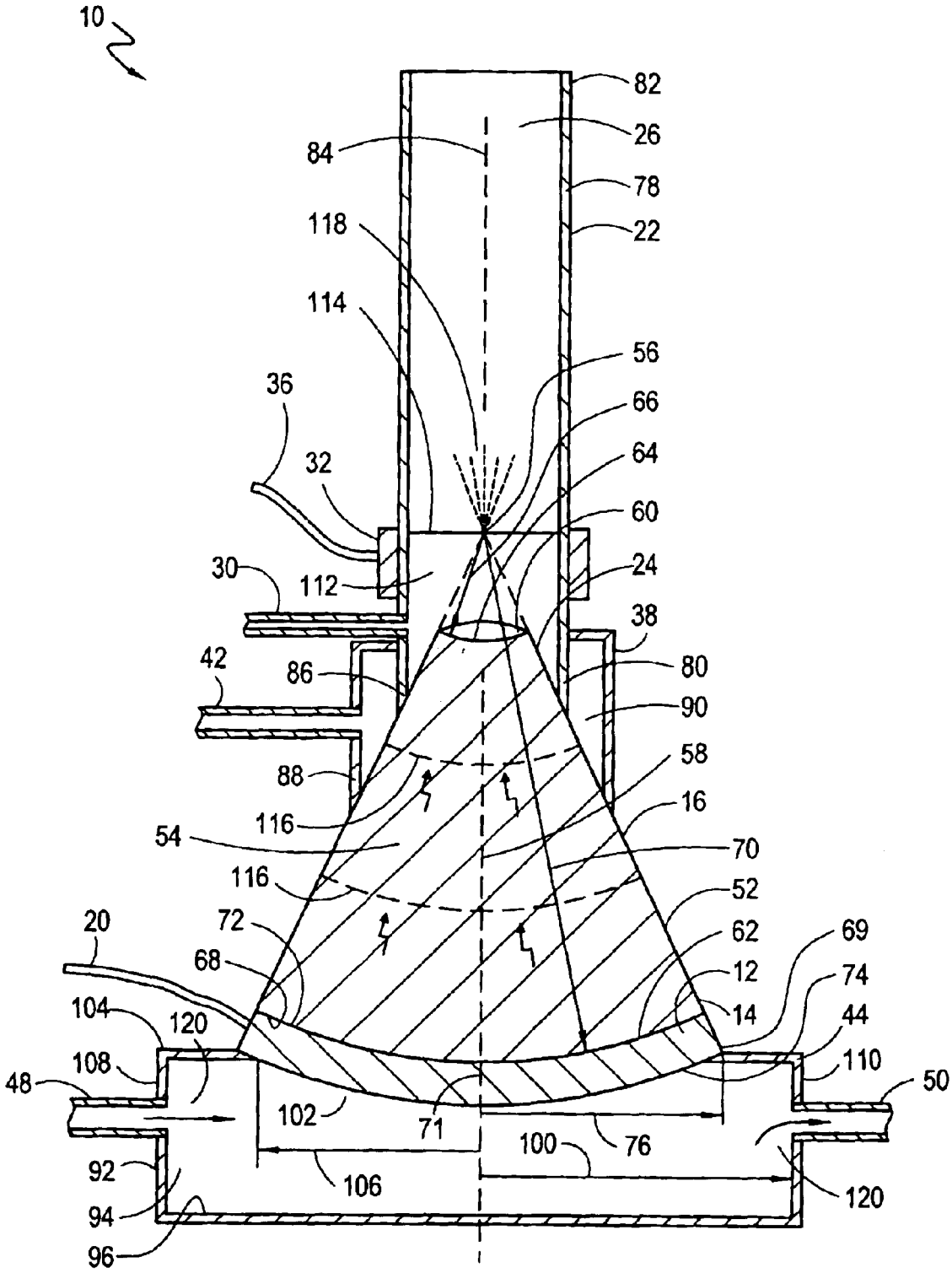
FIG. 2 is a cross-sectional view of the nebulizer as seen along the line 2—2 in FIG. 1.

Referring now to FIG. 2, it can be seen that the conical concentrator 16 has a wall 52 that extends between ends 14 and 24 of the concentrator 16. The concentrator 16 is made of stainless steel. Structurally, the conical concentrator 16 defines a vertex 56 and an axis 58 that passes through the vertex 56. As can be envisioned for the present invention, the vertex 56 is located at a point in space that would be coincident with an apex of the conical concentrator 16 if the conical concentrator 16 was not truncated. Structurally, an enclosure 60 is attached to the concentrator 16 at end 24 and another enclosure 62 is attached to the concentrator 16 at end 14. The enclosure 60 at end 24 has a substantially spherical-shaped concave surface 64 that is located at a radial distance 66 from the vertex 56. The enclosure 62 at end 14 has a substantially spherical-shaped convex surface 68 that is located at a radial distance 70 from the vertex 56. For purposes of the present invention, the radial distance 66 is less than the radial distance 70.

For the present invention, the transducer 12 has a circular-shaped edge 69 and defines an axis 71. The transducer 12 further has a concave surface 72 and a convex surface 74. As shown, the edge 69 borders the surfaces 72 and 74 and extends between the surfaces 72 and 74. More specifically, the concave surface 72 is substantially spherical-shaped and conforms to convex surface 68 of the conical concentrator 16. As shown, the concave surface 72 has a radius of curvature that is approximately equal to the radial distance 70. The convex surface 74 is also substantially spherical-shaped and has a radius of curvature that is greater than the radial distance 70. As shown in FIG. 2, the transducer 12 has a radius 76 that extends perpendicularly outward from the axis 71 to the edge 69 of the transducer 12. For purposes of the present invention, the radius 76 extends to the portion of the edge 69 that is furthest away from the axis 71. Structurally, the convex surface 74 of the transducer 12 is affixed to the convex surface 68 of enclosure 62 so that the axis 71 of the transducer 12 is substantially collinear with the axis 58 of the concentrator 16. Preferably, the transducer 12 is made of a piezoelectric ceramic material.

Still referring to FIG. 2, it can be seen that the droplet manifold 22 has a wall 78 that extends between a proximal end 80 and a distal end 82 of the manifold 22. Moreover, the wall 78 surrounds the liquid chamber 26 and defines a longitudinal axis 84. For purposes of the present invention, the proximal end 80 of the manifold 22 is positioned over the small-diameter end 24 of the concentrator 16 and is placed in contact with the wall 52 of the concentrator 16 at an interface 86 between the proximal end 80 of the manifold 22 and the wall 52 of the concentrator 16. The proximal end 80 of the manifold 22 is tightly pressed against the wall 52 of the concentrator 16 to form a fluid-tight seal at the interface 86. Preferably, the pressure at the interface 86 is created by the weight of the manifold 22 as the proximal end 80 of the manifold 22 rests against the wall 52 of the concentrator 16 at the interface 86. For the present invention, the combination of the concentrator 16 and the manifold 22 forms the liquid chamber 26 inside the manifold 22 with a portion of the liquid chamber 26 existing between the wall 78 of the manifold 22 and the wall 52 of the concentrator 16. Geometrically, the axis 84 of the manifold 22 is substantially collinear with the axis 58 of the concentrator 16 and passes through the vertex 56 of the concentrator 16. Importantly, the vertex 56 of the concentrator 16 is located inside the liquid chamber 26.

In accordance with a preferred embodiment of the present invention, the pressure vessel 38 has a wall 88 that is pressed against the wall 78 of the manifold 22 and bolted to the cooling drum 44 (not shown). Alternatively, the wall 88 can rest against the wall 52 of the concentrator 56 (as shown). In either case, the wall 88 surrounds the interface 86 and forms a pressure chamber 90 between the wall 88 of the pressure vessel 38 and the respective walls 52 and 78 of the concentrator 16 and manifold 22. It will be appreciated, however, that the pressure vessel 38 can have any other structure known to those skilled in the art for establishing an overpressure at the interface 86. For the present invention, the pressure line 42 extends through the wall 88 of the pressure vessel 38 into the pressure chamber 90 to establish fluid communication between the gas compressor 40 (FIG. 1) and the pressure chamber 90.

Still referring to FIG. 2, it can be envisioned for the present invention that the cooling drum 44 has a wall 92 that surrounds a channel 94 and has an interior surface 96. Preferably, the wall 92 and the channel 94 are substantially cylindrical-shaped. In any case, the channel 94 defines an axis 98 and has a radius 100 that extends from the axis 98 to the interior surface 96 of the cooling drum 44. Additionally, the wall 92 of the cooling drum 44 has a circular-shaped opening 102 on a top side 104 of the cooling drum 44. The opening 102 has a radius 106 that is less than the radius 76 of the transducer 12 and is preferably less than the radius 100 of the channel 94. As shown, at least a portion of the transducer 12 is positioned in the opening 102 of the cooling drum 44 with a circular portion of the convex surface 74 contacting the wall 92 of the cooling drum 44 around the opening 102. In this position, a portion of the transducer 12 extends into the channel 94 and a circular portion of the convex surface 74 is exposed in the channel 94. The supply line 48 extends through the wall 92 of the cooling drum 44 into the channel 94 at one end 108 of the cooling drum 44, and the return line 50 extends through the wall 92 of the cooling drum 44 into the channel 94 at the other end 110 of the cooling drum 44. Accordingly, the pump 46 (FIG. 1) is in fluid communication with the channel 94 through both the supply line 48 and the return line 50.

In the operation of the system 10, a high-temperature liquid 112 from the liquid source 28 (FIG. 1) is transferred through the feeding tube 30 into the liquid chamber 26 until a surface 114 of the liquid 112 reaches the vertex 56 of the concentrator 16. For example, the liquid 112 can be liquid sodium hydroxide (NaOH) at a temperature above 320 degrees Centigrade. Importantly, the conical concentrator 16 limits the flow of heat from end 24 to end 14 of the concentrator 16 to keep the transducer 12 below its maximum operating temperature during operation of the system 10. After the surface 114 of the liquid 112 reaches the vertex 56, the power source 18 (FIG. 1) is turned on to activate the transducer 12. In response, the transducer 12 vibrates substantially at its resonant frequency. Preferably, the resonant frequency is approximately two megahertz (2 MHz) or higher. In any case, the transducer 12 launches acoustic waves that have spherical wavefronts 116 in a radial direction from the concave surface 72 of the transducer 12 toward the vertex 56. The spherical wavefronts 116 propagate through enclosure 62, through the interior 54 of the concentrator 16, and through enclosure 60, and then converge at the vertex 56 in the liquid chamber 26. Additionally, portions of the spherical wavefronts 116 may propagate through the wall 52 of the concentrator 16 from end 14 to end 24 as the spherical wavefronts 116 propagate through the concentrator 16. Importantly, the pressure at the interface 86 does not prevent the acoustic waves from propagating through the wall 52 of the concentrator 16. In any event, the energy of the spherical wavefronts 116 is concentrated substantially at the vertex 56 to nebulize the liquid 112 into droplets 118 at the surface 114. Preferably, the diameter of the droplets 118 is less than ten microns (10 $\mu$m). For example, the liquid 112 can be sodium hydroxide (NaOH) that is nebulized into droplets 118 with diameters between one and three microns (1–3 μm). In any case, as the droplets 118 are removed from the liquid 112 in the liquid chamber 26, additional liquid 112 from the liquid source 28 is introduced into the liquid chamber 26 through the feeding tube 30 to maintain the surface 114 of the liquid 112 at the vertex 56.

For the preferred embodiment of the present invention, the gas compressor 40 (FIG. 1) forces a gas through the pressure line 42 into the pressure chamber 90 of the pressure vessel 38 to create an overpressure at the interface 86 between the manifold 22 and the concentrator 16. The overpressure at the interface 86 reinforces the fluid-tight seal at the interface 86 and prevents the liquid 112 from leaking out of the liquid chamber 26 at the interface 86. Importantly, the overpressure that is established at the interface 86 does not prevent the acoustic waves that are generated by the transducer 12 from propagating through the wall 52 of the concentrator 16.

Preferably, the power source 34 (FIG. 1) is turned on to activate the heater 32 during operation of the system 10. In response, the heater 32 heats the liquid 112 in the liquid chamber 26 to maintain the temperature of the liquid 112 above its melting temperature. Preferably, the liquid 112 is maintained above three hundred degrees Centigrade (300° C.). For example, the liquid 112 can be sodium hydroxide (NaOH) that is maintained above three hundred twenty degrees Centigrade (320° C.).

The fluid pump 46 (FIG. 1) is also preferably activated during operation of the system 10. In its operation, the fluid pump 46 forces a coolant 120 through the channel 94 of the cooling drum 44. The coolant 120 flows across the convex surface 74 of the transducer 12 to absorb heat from the transducer 12 and thereby cool the transducer 12. The coolant 120 can also absorb ambient heat in the channel 94 to cool the transducer 12. The pump 46 then removes the coolant 120 from the channel 94 through the return line 50 and removes heat from the coolant 120 through a heat exchanger in the fluid pump 46. As can be envisioned for the present invention, the pump 46 circulates the coolant 120 through the supply line 48, the channel 94, and the return line 50. Preferably, the pump 46 is a water pump and the coolant 120 is water. Another liquid coolant or gas refrigerant, however, can be circulated through the channel 94 to cool the transducer 12. Importantly, the cooling drum 44 does not prevent the transducer 12 from vibrating or generating acoustic waves when an electric field is applied to the transducer 12.

While the particular nebulizer system and method as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A system for nebulizing a high-temperature liquid which comprises:

a conical concentrator having a first end and a second end, said conical concentrator defining a vertex;

an enclosure attached to the first end of said concentrator, said enclosure having a substantially spherical-shaped surface located at a first radial distance from the vertex;

a transducer attached to the second end of said concentrator, said transducer having a substantially spherical-shaped surface located at a second radial distance from the vertex, wherein the second radial distance is greater than the first radial distance;

a substantially cylindrical-shaped droplet manifold defining an axis and having a first end and a second end, with the first end of said manifold positioned over the first end of said concentrator to press against said concentrator with a substantially fluid-tight seal at an interface therebetween to establish a liquid chamber in said manifold, wherein the axis of said manifold substantially passes through the vertex of said concentrator;

a tube for introducing the high-temperature liquid into said liquid chamber to maintain a surface level for the liquid substantially at the vertex; and a means for activating said transducer to launch acoustic waves in a direction therefrom toward the vertex to nebulize the liquid into droplets.

2. A system as recited in claim 1 further comprising a heater surrounding said liquid chamber to maintain the liquid above a melting temperature of the liquid.

3. A system as recited in claim 2 wherein said heater maintains the liquid at a temperature above approximately three hundred degrees Centigrade (300° C.).

4. A system as recited in claim 1 further comprising a pressure vessel surrounding the interface between said concentrator and said manifold to create an overpressure at the interface to prevent a leak of the liquid from said liquid chamber.

5. A system as recited in claim 1 further comprising:

a cooling drum having a wall surrounding a channel, with a substantially circular opening formed through said wall, wherein a portion of said transducer is positioned in said opening to extend into said channel; and a pumping means for passing a coolant through said channel, wherein the coolant absorbs heat from said transducer as the coolant passes through said channel.

6. A system as recited in claim 1 wherein said transducer is made of a piezoelectric ceramic material.

7. A system as recited in claim 1 wherein said transducer has a resonant frequency of approximately 2 MHz.

8. A system as recited in claim 1 wherein said conical concentrator is made of stainless steel.

9. A system as recited in claim 1 wherein the droplets have a diameter in the range of one to three microns (1–3 μm).

10. A system as recited in claim 1 wherein said transducer is maintained below a temperature of approximately 100 degrees Centigrade (100° C.).

11. A system for nebulizing a high-temperature liquid which comprises:

a means for holding the liquid, with the liquid having an exposed surface;

a means for generating an acoustic wave with a spherical wavefront;

a means for directing said acoustic wave for convergence of the wavefront at a point in the holding means;

a means for distancing said generating means from the liquid in the holding means to thermally isolate said generating means from the liquid; and a means for maintaining the surface level of the liquid substantially coincident with the point in the holding means to nebulize the liquid into droplets at the point.

12. A system as recited in claim 11 wherein said distancing means thermally insulates said generating means from the liquid.

13. A system as recited in claim 11 further comprising a means for cooling said generating means, said cooling means positioned adjacent to said generating means.

14. A system as recited in claim 13 wherein said cooling means maintains said generating means at a temperature below approximately one hundred degrees Centigrade (100° C.).

15. A system as recited in claim 11 wherein said liquid is dry sodium hydroxide (NaOH) at a temperature above three hundred and twenty degrees Centigrade (320° C.).

16. A system as recited in claim 15 wherein the droplets have a diameter in the range of one to three microns (1–3 $\mu$m).

17. A method for nebulizing a high-temperature liquid, which comprises the steps of:

holding the liquid in a receptacle, with the liquid having an exposed surface;

distancing a transducer from the liquid to thermally insulate said transducer from the liquid;

activating said transducer to generate acoustic waves with spherical wavefronts;

directing said acoustic waves for convergence of the wavefronts at a point in said receptacle; and maintaining the surface level of the liquid substantially coincident with the point to nebulize the liquid into droplets at the point.

18. A method as recited in claim 17 further comprising the step of heating the liquid in said receptacle to maintain the liquid at a temperature above approximately three hundred degrees Centigrade (300° C.).

19. A method as recited in claim 17 further comprising the step of cooling said transducer to maintain said transducer at a temperature below approximately one hundred degrees Centigrade (100° C.).

20. A method as recited in claim 19 wherein said step of cooling said transducer comprises the steps of:

providing a cooling drum having a wall surrounding a channel, with a substantially circular opening formed through said wall;

positioning a portion of said transducer through said opening into said channel; and pumping a coolant through said channel to absorb heat from said transducer.

* * * * *